US006685778B2

(12) United States Patent
Davis et al.

(10) Patent No.: US 6,685,778 B2
(45) Date of Patent: Feb. 3, 2004

(54) LANE DRESSING SUPPLY SYSTEM FOR BOWLING LANE MAINTENANCE MACHINES

(75) Inventors: Mark E. Davis, Sebring, FL (US); Anthony K. Crews, Sebring, FL (US); Steven L. Sowards, Sebring, FL (US); John M. Davis, Sebring, FL (US)

(73) Assignee: The Kegel Company, Inc., Lake Wales, FL (US)

( * ) Notice: Subject to any disclaimer, the term of this patent is extended or adjusted under 35 U.S.C. 154(b) by 280 days.

(21) Appl. No.: 10/057,103

(22) Filed: Oct. 25, 2001

(65) Prior Publication Data

US 2003/0140848 A1 Jul. 31, 2003

(51) Int. Cl.[7] ..... B05C 1/00

(52) U.S. Cl. ..... 118/684; 118/207; 118/244; 118/262; 118/264; 15/50.3; 15/4; 15/98; 15/320

(58) Field of Search ..... 118/684, 207, 118/244, 262, 264; 15/50.3, 4, 98, 320

(56) References Cited

U.S. PATENT DOCUMENTS 5,650,012 A 7/1997 Davis ..... 118/681
5,679,162 A * 10/1997 Caffrey et al. ..... 118/684
5,729,855 A * 3/1998 Davis ..... 15/50.3

* cited by examiner

*Primary Examiner*—Laura Edwards
(74) *Attorney, Agent, or Firm*—Hovey Williams LLP

(57) ABSTRACT

A lane maintenance machine having wicks that absorb dressing from a reservoir and transfer it to the applicator of the machine has a gravity-fed dressing supply system that maintains the dressing at a substantially constant level within the wick reservoir. A small pilot chamber upstream from the reservoir and in open communication therewith at the same elevation as the reservoir has its fluid level directly controlled by a float sensor to in turn indirectly control the level within the wick reservoir. The float sensor within the pilot chamber provides a signal to a controller when the level within the pilot chamber drops below a predetermined point so that a control valve between the pilot chamber and the main supply tank opens to allow a makeup volume of dressing to flow by gravity from the main tank into the pilot chamber. Vent conduits associated with the main tank and the pilot chamber also serve as a means for accepting dressing that drains from the reservoir when the machine is upended into a transport position, thus preventing spillage of dressing through the open top of the wick reservoir.

7 Claims, 5 Drawing Sheets

LANE DRESSING SUPPLY SYSTEM FOR BOWLING LANE MAINTENANCE MACHINES

TECHNICAL FIELD

The present invention relates to the field of maintenance machines that apply oil or other dressing to the surface of bowling lanes and, more particularly, to improvements in the manner in which the dressing is supplied to applicator wicks used in such machines.

BACKGROUND

It is known in the prior art that wick-type lane maintenance machines, wherein wicks are used to absorb lane oil from a reservoir and apply it to a transfer roller or other applicator, perform best when the oil within the reservoir is maintained at a substantially constant, predetermined level. If the oil level is allowed to decrease significantly, the rate of oil transferred by the wick will drop, which makes it difficult to apply an identical oil pattern to all lanes of a bowling establishment. In prior U.S. Pat. No. 5,650,012 assigned to the assignee of the present invention, the oil level within the wick reservoir is maintained substantially constant by continuously pumping oil from a supply tank into the wick reservoir and having it overflow and return back to the supply tank. Thus, the oil level is maintained at the level of the overflow outlet.

In one alternative embodiment disclosed in the '012 patent, the oil from the pump flows first into a small chamber immediately upstream from the wick reservoir that is in constant communication with the wick reservoir. The overflow outlet remains located in the wick reservoir and overflowing oil is returned back to the main supply tank.

SUMMARY OF THE INVENTION

In accordance with the present invention a lane maintenance machine that uses absorbant wicks as part of the dressing application system of the machine automatically maintains dressing at a substantially constant level in the wick reservoir without the use of a pump or overflow system as found in the prior art. The present invention relies solely upon gravity to feed makeup dressing to the wick reservoir if and when such dressing is necessary to maintain the predetermined, optimum level of dressing in the reservoir. A float switch functions to determine whether the level is below the set point and, if so, it signals a controller or otherwise causes a control valve to open a supply conduit from an elevated main tank so that makeup dressing can flow by gravity into the reservoir. In a preferred embodiment of the invention, a relatively small pilot chamber upstream from the wick reservoir but in open communication therewith is placed at such a height that the fluid level in the pilot chamber and the wick reservoir are always the same. Thus, the level of fluid in the wick reservoir can be indirectly controlled by controlling the fluid level in the pilot chamber. To this end, the float sensor is located within the pilot chamber, rather than in the wick reservoir. Constant opening and closing of the float switch as it seeks to maintain a constant fluid level is prevented by having a relatively long stretch of supply conduit between the control valve and the pilot chamber so that, even after the float switch has been deactuated by the fluid level returning to its set point, the volume of fluid in the supply conduit downstream from the pilot valve overfills the control chamber to a certain extent above the set point.

DETAILED DESCRIPTION

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

The lane machine 10 shown throughout the figures may, for example take the form of that illustrated in U.S. Pat. No. 5,650,012. Accordingly, the '012 patent is incorporated herein by reference for a disclosure of those aspects of machine 10 not specifically set forth in the description and drawings of the present specification. In view of the foregoing incorporation by reference, and in view further of the level of ordinary skill in the art and state of the prior art in general, many of the components of machine 10 are only schematically illustrated and will only be briefly discussed herein.

Figure 1:
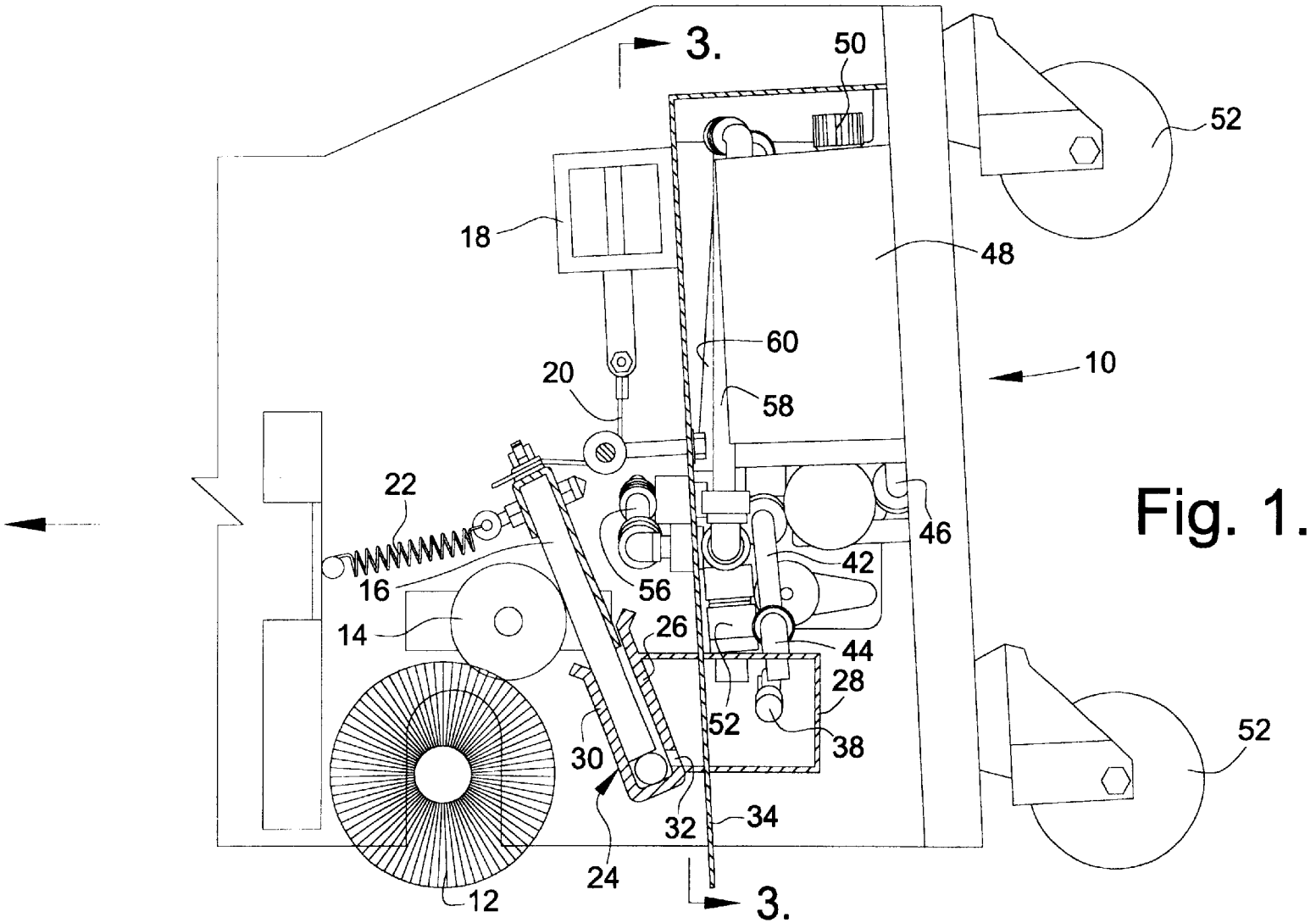
FIG. 1 is a fragmentary vertical cross sectional view through a lane machine incorporating one preferred embodiment.

Lane oil or other dressing is applied to the lane by a brush-type applicator roll 12 that spans the lane and makes contacting engagement therewith as the machine moves from right to left viewing FIG. 1. Applicator roll 12 receives its oil from a transfer roll 14 that is at least coextensive in length with applicator 12 and extends parallel thereto. Transfer roll 14 in turn receives its oil from a bank of absorbent wicks 16, each of which can be flexed into and out of contacting engagement with transfer roll 14 by its own solenoid actuator 18, cable 20 and return spring 22. Wicks 16 are received within a generally transversely U-shaped, open top reservoir 24, the depth of reservoir 24 being such that a lower portion of each wick is housed within reservoir 24 while an upper portion projects upwardly out of and beyond reservoir 24 for contacting engagement with transfer roll 14, unless that particular wick 16 has been pulled out of such contact by its solenoid 18. Reservoir 24 contains oil that is absorbed by wicks 16 and which migrates to the upper portion thereof by capillary action.

Figure 4:
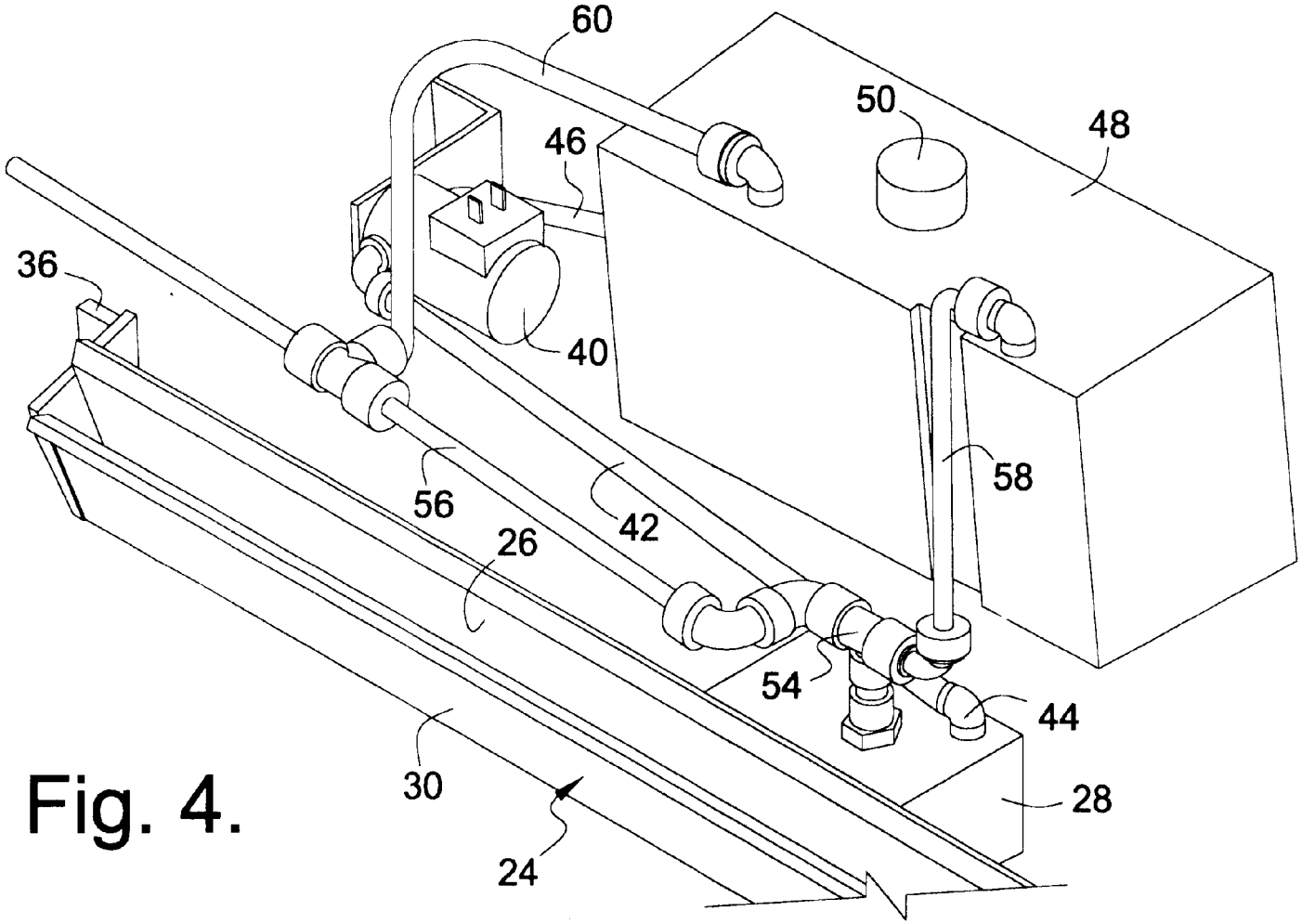
FIG. 4 is a fragmentary isometric view of the wick reservoir and dressing supply system in accordance with the present invention.
Figure 5:
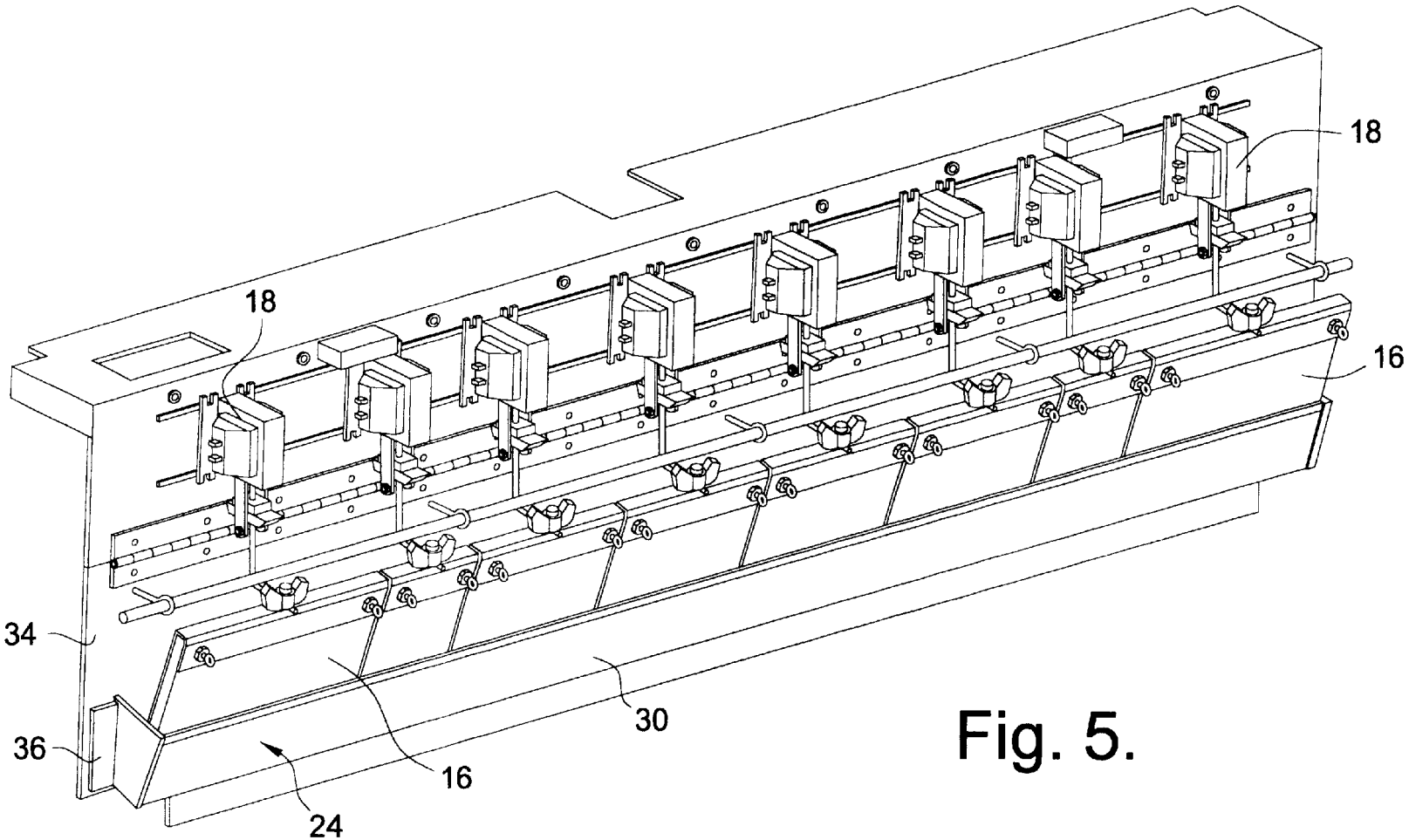
FIG. 5 is an isometric view of the wick reservoir and associated wicks and solenoid actuators of the machine.

Wick reservoir 24 has a back wall 26 to which is integrally secured a relatively small, rectangular pilot chamber 28. The bottom of pilot chamber 28 is located at substantially the same level as the bottom of the rear wall 26, while the top of pilot chamber 28 is located at substantially the same level as the upper edge of the front wall 30 of reservoir 24. A horizontal slot 32 in back wall 26 adjacent its lower extremity communicates the interior of pilot chamber 28 with the interior of reservoir 24. Pilot chamber 28 passes through an upright structural bulkhead 34 within machine 10, while opposite ends of reservoir 24 are fixedly secured to bulkhead 34 by generally L-shaped angle brackets 36 (only one being shown; see FIGS. 4 and 5).

Pilot chamber 28 serves as an indirect means of maintaining a substantially constant level of oil within reservoir 24. To this end, pilot chamber 28 contains a liquid level sensor 38 in the nature of a float switch that signals a controller (not shown) or completes a control circuit for actuating a control valve 40 to open and close a supply conduit 42 leading downhill from valve 40 to pilot chamber 28. Because pilot chamber 28 is located below control valve 40, oil allowed to enter conduit 42 at its upper end by control valve 40 flows by gravity into the pilot chamber 28 via an inlet 44 within the top wall of chamber 28. In one preferred embodiment, sensor 38 comprises a magnetic float switch available from Madison Company as part number M8700, while control valve 40 comprises an electrically actuated shut-off valve available from Snap Tite Valves, part number 2823B-2NT-VCF.

Control valve 40 is connected via another supply conduit 46 to the bottom region of a main supply tank 48, the tank 48 being located at a higher elevation than control valve 40 so that oil flows by gravity from tank 48 to control valve 40 via the downwardly inclined supply conduit 46. A removable cap 50 on tank 48 permits periodic refilling of tank 48.

Figure 2:
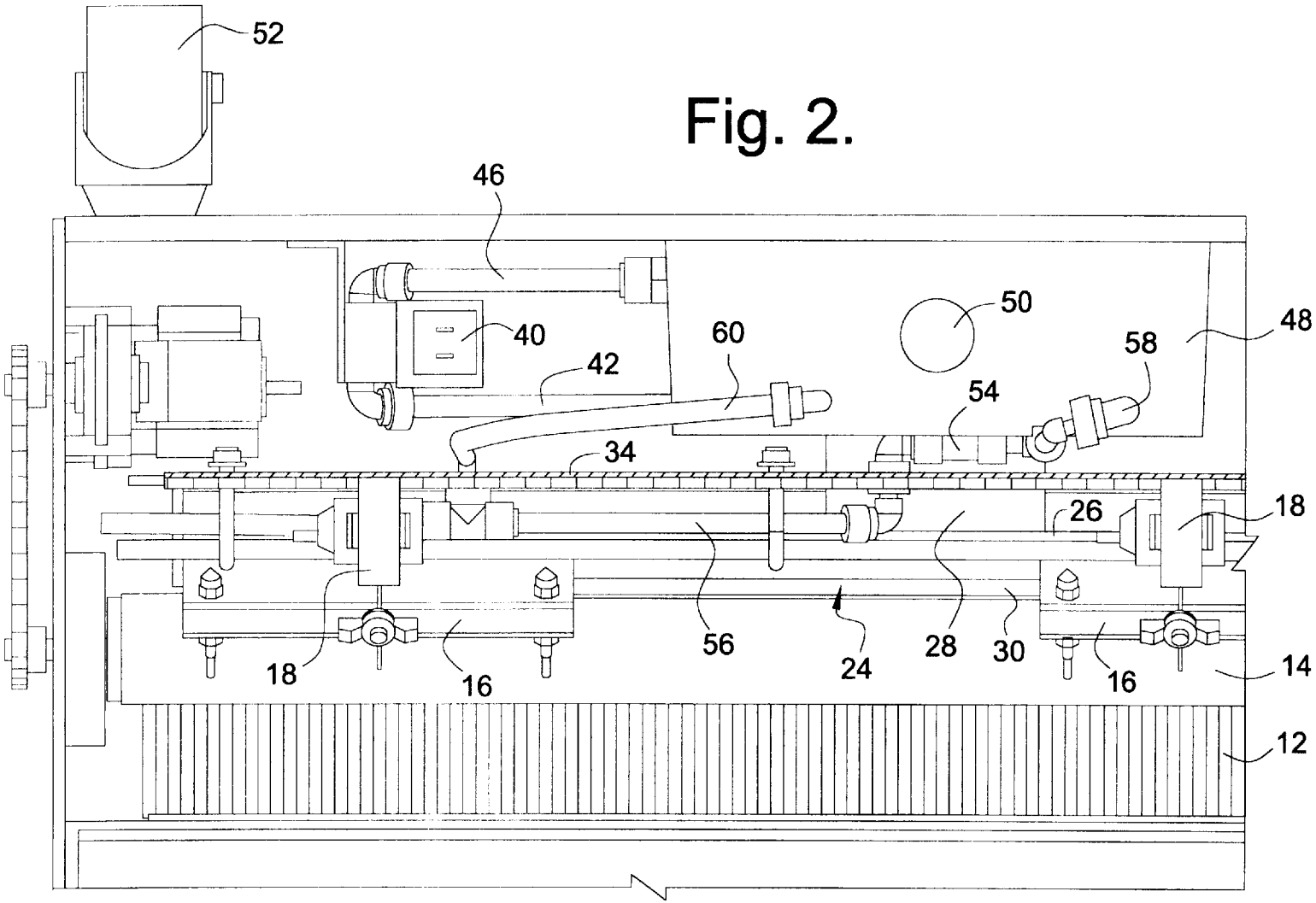
FIG. 2 is a fragmentary top plan view thereof with one of the wick assemblies removed to reveal details of construction of the dressing supply system in accordance with the present invention.
Figure 3:
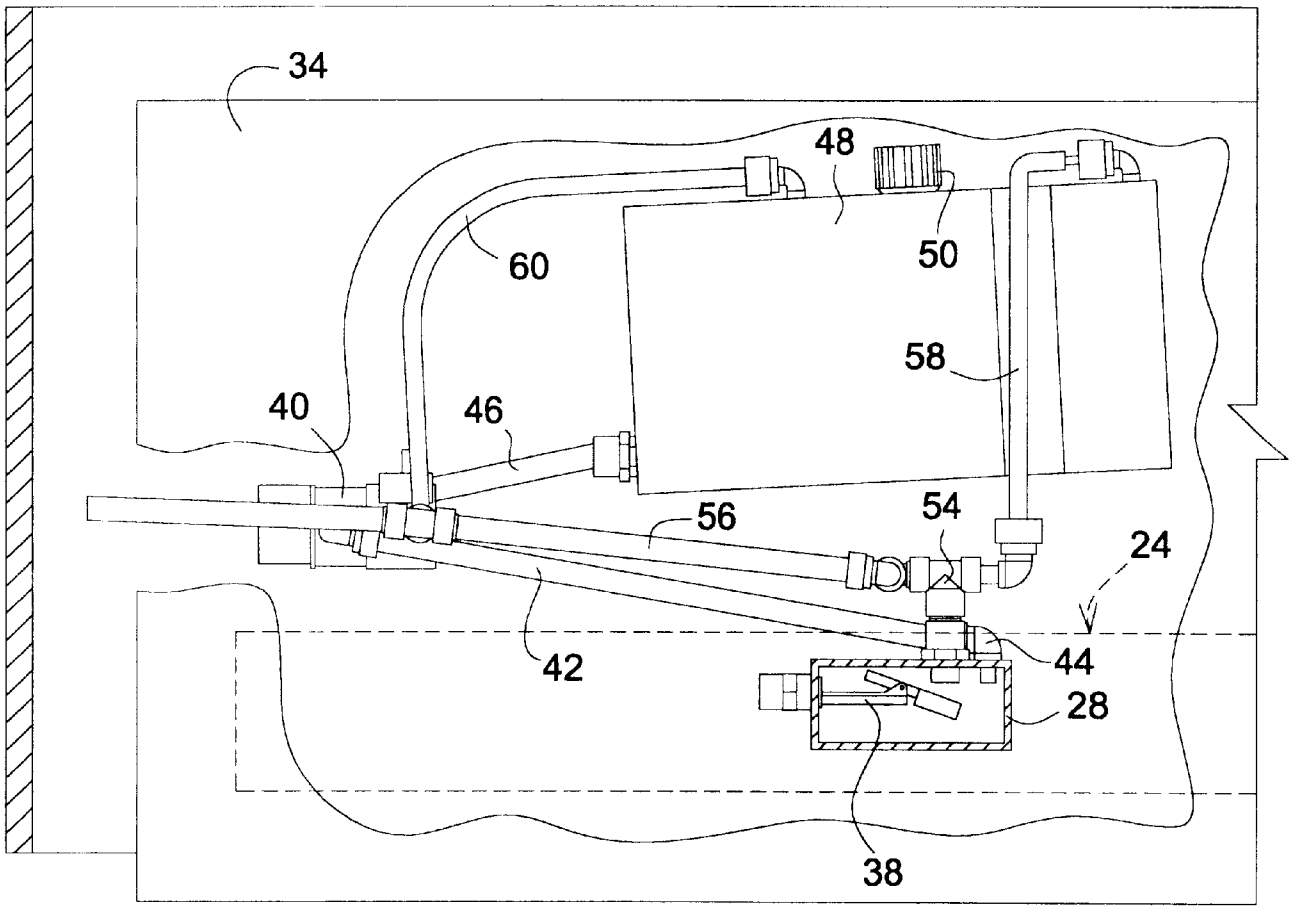
FIG. 3 is a fragmentary vertical cross sectional view through the machine taken generally along line 3—3 of FIG. 1.

The dressing supply system thus far described is provided with a number of vent lines that not only serve to vent tank 48 and control chamber 28 to the atmosphere, but also serve as temporary storage space for dressing that drains from reservoir 24 when machine 10 is upended 90° and placed in a transport position wherein ground wheels 52 (FIGS. 1 and 2) support the machine for easy rolling thereof to and from the operating site. In this regard, a generally T-shaped fitting 54 rises from the top wall of chamber 28 in open communication with the interior thereof and is joined with a vent conduit 56 that passes through bulkhead 34 and runs up hill from fitting 54 to a point generally adjacent the proximal end of transfer roll 14. Another vent conduit 58 leads from the top wall of tank 48 down to fitting 54 to establish open communication between the upper region of tank 48 and vent conduit 56. A third vent conduit 60 leads from the top wall tank 48 directly to the vent conduit 56 generally adjacent the outboard end of conduit 56. Vent conduit 60 connects to tank 48 at a location spaced laterally from the connection of vent conduit 58 to tank 48.

Operation

In use, machine 10 is positioned as illustrated in FIG. 1 with the applicator roll 12 contacting the lane surface. As machine 10 advances along the lane, the rotating applicator roll 12 applies lane dressing thereto in a predetermined pattern determined by a controller of the machine which causes different ones of the wicks 16, or all of them, to be flexed into and out of contacting engagement with transfer roll 14 at certain locations along the lane. Oil contained within pilot chamber 28 flows freely to wick reservoir 24 via open slot 32, and the level of oil within reservoir 24 matches that within pilot chamber 28 due to hydraulic pressure.

If the level within pilot control chamber 28 drops below the desired point, that condition is sensed by float switch 38 which in turn signals the controller to open control valve 40. When control valve 40 opens, oil from tank 48 and supply conduit 46 flows by gravity through valve 40 and supply conduit 42 into chamber 28 to replenish the supply. When float switch 38 is then closed by the rising oil level within chamber 28, a signal is received by the controller which in turn re-closes control valve 40. This shuts off supply conduit 46 so that no additional fluid can reach supply conduit 42; however, there is a significant residual amount left in supply conduit 42 when valve 40 is re-closed, and that amount continues to gravitate into chamber 28 until supply conduit 42 is completely emptied. Thus, to a certain extent, control chamber 28 is somewhat overfilled during each refill cycle, although the relatively small volume of chamber 28 compared to the much larger volume of reservoir 24 causes such overfilling to have very little effect on the level of oil within reservoir 24. Consequently, using the benefits of gravity flow, the level of oil within reservoir 24 can be maintained at substantially the same level throughout the life of the supply of oil within main tank 48.

It will be noted that as the supply of oil drops within main tank 48, the void left by the departing dressing is immediately filled by ambient air at atmospheric pressure via the vent conduits 56, 58 and 60. Moreover, it will be noted that when machine 10 is upended into its transport position wherein wheels 52 are engaging the ground, oil drains from reservoir 24 into chamber 28 via open slot 32. To the extent chamber 28 is unable to handle the volume of oil coming from reservoir 24, such additional volume flows into one or more of the vent conduits 56, 58 and 60 via the fitting 54. A certain amount can also be accepted by the supply conduit 42 via inlet 44.

Float switch 38 can also serve as a means of alerting the operator to a low oil condition or that a problem exists with the oil flow, such as an obstruction in the supply line. Typically, during normal operations, switch 38 closes for only short intervals of time, e.g. less than thirty seconds each. Thus, if switch 38 remains closed for more than thirty seconds, for example, it is probably attempting to supply more oil to pilot chamber 28 than is available, for one reason or another. Such prolonged closure of switch 38 can be recognized by the controller (not shown) of the machine, which in turn causes an appropriate error message to appear on a display (not shown) of the machine that alerts the operator to take appropriate steps to rectify the problem.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

What is claimed is:

1. In a bowling lane maintenance machine having a lane dressing application system, the improvement comprising:

a roller;

a dressing reservoir adjacent said roller;

a wick received within said reservoir and having a portion that projects upwardly out of the reservoir for use in transferring dressing to said roller by contacting engagement therewith;

a dressing supply tank coupled with the reservoir in a manner to provide dressing to the reservoir by gravity flow;

a control valve operable when open to permit dressing flow from the tank to the reservoir by gravity and when closed to preclude such flow; and a dressing level sensor operably coupled with said valve for opening and closing the valve in a manner to maintain the level of dressing within the reservoir substantially constant.

2. In a bowling lane maintenance machine as claimed in claim 1, further including a pilot chamber upstream from the reservoir and downstream from the supply tank, said pilot chamber being in open flow communication with the reservoir and being located at such a height that dressing in the pilot chamber and the reservoir are maintained at substantially the same level, said sensor being located within said pilot chamber and being responsive to changes in the level of dressing within said pilot chamber.

3. In a bowling lane maintenance machine as claimed in claim 2, said pilot chamber being substantially shorter than said reservoir in a direction transverse to the path of travel of the machine.

4. In a bowling lane maintenance machine as claimed in claim 2, said sensor comprising a float switch.

5. In a bowling lane maintenance machine as claimed in claim 2, further including a dressing supply conduit extending between the control valve and the pilot chamber, said supply conduit being disposed to receive dressing that drains from the pilot chamber when the machine is upended for transport.

6. In a bowling lane maintenance machine as claimed in claim 5, further including vent conduits communicating the supply tank and the pilot chamber with atmosphere, said vent conduits being disposed to receive and collect dressing that drains from the pilot chamber when the machine is upended for transport.

7. In a bowling lane maintenance machine as claimed in claim 1, said sensor comprising a float switch.

* * * * *